US006378439B1

(12) United States Patent
Saxby

(10) Patent No.: US 6,378,439 B1
(45) Date of Patent: Apr. 30, 2002

(54) MARKER PROJECTILE

(76) Inventor: Michael Ernest Saxby, 82 Cowdray Park, Little Common, Bexhill-on-Sea, East Sussex, TN39 4EZ (GB)

( * ) Notice: Subject to any disclaimer, the term of this patent is extended or adjusted under 35 U.S.C. 154(b) by 0 days.

(21) Appl. No.: 09/255,966

(22) Filed: Feb. 23, 1999

(30) Foreign Application Priority Data

Feb. 1, 1999 (GB) ..... 9902109

(51) Int. Cl.[7] ..... F42B 12/40
(52) U.S. Cl. ..... 102/513
(58) Field of Search ..... 102/513

(56) References Cited

U.S. PATENT DOCUMENTS

| | | | | | |
|---|---|---|---|---|---|
| 3,374,741 | A | * | 3/1968 | Bass | 102/513 |
| 3,429,263 | A | * | 2/1969 | Snyder et al. | 102/513 |
| 3,477,375 | A | | 11/1969 | Barr | 102/45 |
| 3,528,662 | A | | 9/1970 | Merchant et al. | 273/106.5 |
| 3,782,286 | A | | 1/1974 | Jones et al. | 102/41 |
| 3,837,284 | A | | 9/1974 | Waldeisen | 102/92 |
| 3,952,662 | A | | 4/1976 | Greenlees | 102/92.7 |
| 4,128,059 | A | | 12/1978 | Black | 102/92.7 |
| 4,204,474 | A | | 5/1980 | Mizelle | 102/92.7 |
| 4,448,106 | A | | 5/1984 | Knapp | 89/1 A |
| H114 | H | | 8/1986 | Quintavalle | 102/513 |
| 4,637,616 | A | | 1/1987 | Whiting | 273/418 |
| 4,686,905 | A | | 8/1987 | Szabo | 102/444 |
| 4,823,702 | A | | 4/1989 | Woolsey | 102/502 |
| 4,899,660 | A | * | 2/1990 | Brighton | 102/513 |
| 4,932,329 | A | * | 6/1990 | Logie | 102/513 X |
| 5,361,700 | A | * | 11/1994 | Carbone | 102/513 X |
| 5,448,951 | A | * | 9/1995 | Olsen | 102/513 |
| 5,760,329 | A | * | 6/1998 | Baum et al. | 102/513 X |
| 5,936,190 | A | * | 8/1999 | Buzick | 102/513 X |

FOREIGN PATENT DOCUMENTS

| | | |
|---|---|---|
| GB | 1263522 | 2/1972 |
| GB | 1309362 | 3/1973 |
| GB | 1371482 | 10/1974 |
| GB | 2284252 A | 5/1995 |
| WO | WO 91/14916 | 10/1991 |
| WO | WO 95/05573 | 2/1995 |

* cited by examiner

*Primary Examiner*—Peter A. Nelson
(74) *Attorney, Agent, or Firm*—Lahive & Cockfield, LLP

(57) ABSTRACT

A projectile arrangement in which an expelling member such as a steel ball is held within the projectile interior behind a marking substance, such that upon impact and arrest of the movement of an outer casing of the projectile, the momentum of the expelling member carries it forward relative to the outer casing to expel the marking substance through the front of the projectile.

25 Claims, 3 Drawing Sheets

MARKER PROJECTILE

The present invention relates to a marker projectile and to the combination of a marker projectile and a cartridge.

BACKGROUND

Marker projectiles for use in training or war games are well known and examples of such projectiles are disclosed in U.S. Pat. No. 4,686,905, GB 2 284 252, GB 1 263 522, U.S. Pat. No. 3,528,662, U.S. Pat. No. 4,128,059 and U.S. Pat. No. 3,782,286.

Most of the aforementioned patents disclose projectiles in which a marker substance is held within a frangible casing or enclosure which ruptures upon impact with a target. A problem with projectiles such as bullets that are intended to break upon impact is that sometimes they fail to break. Moreover, because of the high impact required to break the frangible casing or enclosure, the projectiles can often cause injury upon impact with a person. A further problem is that the frangible casings or enclosures can sometimes break in a gun during the gun's reloading cycle.

Some of the aforementioned problems are addressed in GB 2 284 252 which discloses a projectile comprising a hollow casing having a perforated nose portion, a piston disposed within the casing, and a marking substance disposed forwardly of the piston. The piston is movable forwardly under force applied to it by gas used to discharge the projectile thereby compressing the marking substance and expelling it through the nose portion which thus becomes coated with the marking substance. Upon impact with a target, the marking substance is transferred to the target to mark the target.

However, a problem with projectiles, such as those disclosed in GB 2 284 252, in which the nose portion of the projectile is coated with a marking substance even before the projectile has left the gun barrel, is that the marking substance is dispersed by the rotation imparted to the projectile by the rifling in the gun barrel. Thus, the centrifugal force imparted by the spinning bullet causes the marking substance to move radially outwardly and consequently it can foul the barrel of the gun. A build up of marking substance, or its thermal decomposition products, in the gun barrel over time will inevitably have an adverse effect on the working of the gun. This problem is greatly exacerbated with bullets designed for use in high velocity rifles such as the NATO and U.S. 5.56 mm calibre rifles where the rifling in the barrel must be such as to impart a very high spin rate to the bullet in order to ensure a stable trajectory. Even with relatively low velocity training ammunition, the high spin rates imparted by the rifling in high velocity rifles are still sufficient to cause the marking substance to disperse in the manner described above.

A still further problem with the marker projectile of GB 2 284 252 and other known marker projectiles is that they are unsuitable for small calibre barrels such as the current NATO and U.S. 5.56 mm calibre self loading rifle barrels. This is not only because of the problem of radial dispersion of the marking substance referred to above, but also because the complexity of the bullet poses considerable manufacturing difficulties with smaller calibre bullets.

SUMMARY OF THE INVENTION

It is an object of the invention to provide a marker projectile which overcomes or at least substantially alleviates the aforementioned problems.

The solution provided by the present invention is to provide an arrangement in which an expelling member such as a steel ball is held within the projectile interior behind the marking substance such that upon impact and arrest of the movement of the outer casing of the projectile, the momentum of the expelling member carries it forward relative to the outer casing to expel the marking substance through the front of the projectile.

Accordingly, in a first aspect, the invention provides a marker projectile comprising a hollow body having an opening at the front; a marker substance disposed within the hollow body; and an expelling member within the hollow body behind the marking substance; characterised in that the hollow body and expelling member are configured such that upon impact of the projectile with a target, the momentum of the expelling member relative to the hollow body carries the expelling member forwardly to expel the marking substance through the opening.

Thus, in the marker projectile of the invention, it is the momentum of the expelling member within the hollow body of the projectile which carries it forwardly after impact of the projectile with the target so as to force the marking substance out of the opening in the front of the projectile, This feature distinguishes the projectile of the invention from known projectiles such as those disclosed in GB 2 284 252 where a piston within the projectile is driven forwardly by the propellant gases in the cartridge or gun to expel the marker substance.

In the projectiles of the invention, the expelling member is insulated from the propellant gases; in other words, the propellant gases do not act on the expelling member to force it forwardly to cause expulsion of the marking substance.

In one embodiment, the hollow body comprises a sleeve having a core body portion secured within a rear end thereof, the inner wall of the sleeve and a forwardly facing surface of the core body portion defining a chamber within which the marking substance and expelling member are disposed. The sleeve typically has a cylindrical form, a spigot portion of the core body member being received (preferably non-slidably) within the rear end of the sleeve. The sleeve is preferably formed from a material having a greater density than the material from which the core body portion is formed. Thus, for example, the sleeve can be formed from a metal material such as aluminium and the core body portion can be formed from a plastics material. The advantage of this feature is that (with the exception of the expelling member) the mass of the hollow body is concentrated towards its outer circumference which improves its ballistic qualities.

It is most preferred that the hollow body is provided with means for centring the expelling member therein during flight of the projectile. By providing centring means, lateral movement of the expelling member during flight is prevented and the destabilising effect of such movement is therefore avoided. The centring means can be a recess in a forwardly facing surface within the interior of the hollow body. Where the hollow body comprises a core body portion and a sleeve, the centring means can comprise a recess in the forwardly facing surface of the core body portion. The recess constituting the centring means can be conical, frustoconical, hemispherical or part hemispherical, for example.

The expelling member can take a variety of shapes provided that it is rotationally symmetrical about its longitudinal axis. Preferably it is of a spherical shape and more preferably it is a solid sphere.

The expelling member is typically formed from a material having a greater density than the materials) from which the hollow body is formed. Thus, for example, the expelling member can be formed from steel. Where the projectile comprises a sleeve and core body portion, it is preferred that the expelling member has a greater density than the sleeve and the core body portion. It will appreciated also that, typically, the expelling member will have a density greater than the density of the marking substance.

In order to ensure that the expelling member can be carried forwardly by its own momentum within the hollow body upon impact with a target without its motion being retarded by frictional engagement with an inner surface of the hollow body, there is preferably a radial clearance between the centred expelling member and the inner wall of the hollow body (e.g. sleeve) sleeve.

In the projectiles of the invention, the motivating force urging the expelling member forwardly against the marking substance is the expelling member's own momentum. There is no need for a piston/cylinder arrangement driven by the expanding propellant gases within the gun barrel upon firing. On the contrary, where a core body portion/sleeve arrangement is used, means are typically provided for preventing forward movement of the core body portion in the manner of a piston relative to the sleeve. Such means can take the form of an abutment surface, for example an abutment flange, on the core body portion which rests against a rearwardly facing surface of the sleeve.

The present invention also contemplates the combination of a cartridge and a marker projectile as hereinbefore defined.

BRIEF DESCRIPTION OF THE DRAWINGS

The invention will now be illustrated by way of example with reference to the specific embodiment shown in the accompanying drawings of which.

DESCRIPTION OF THE PREFERRED EMBODIMENT

Figure 1:
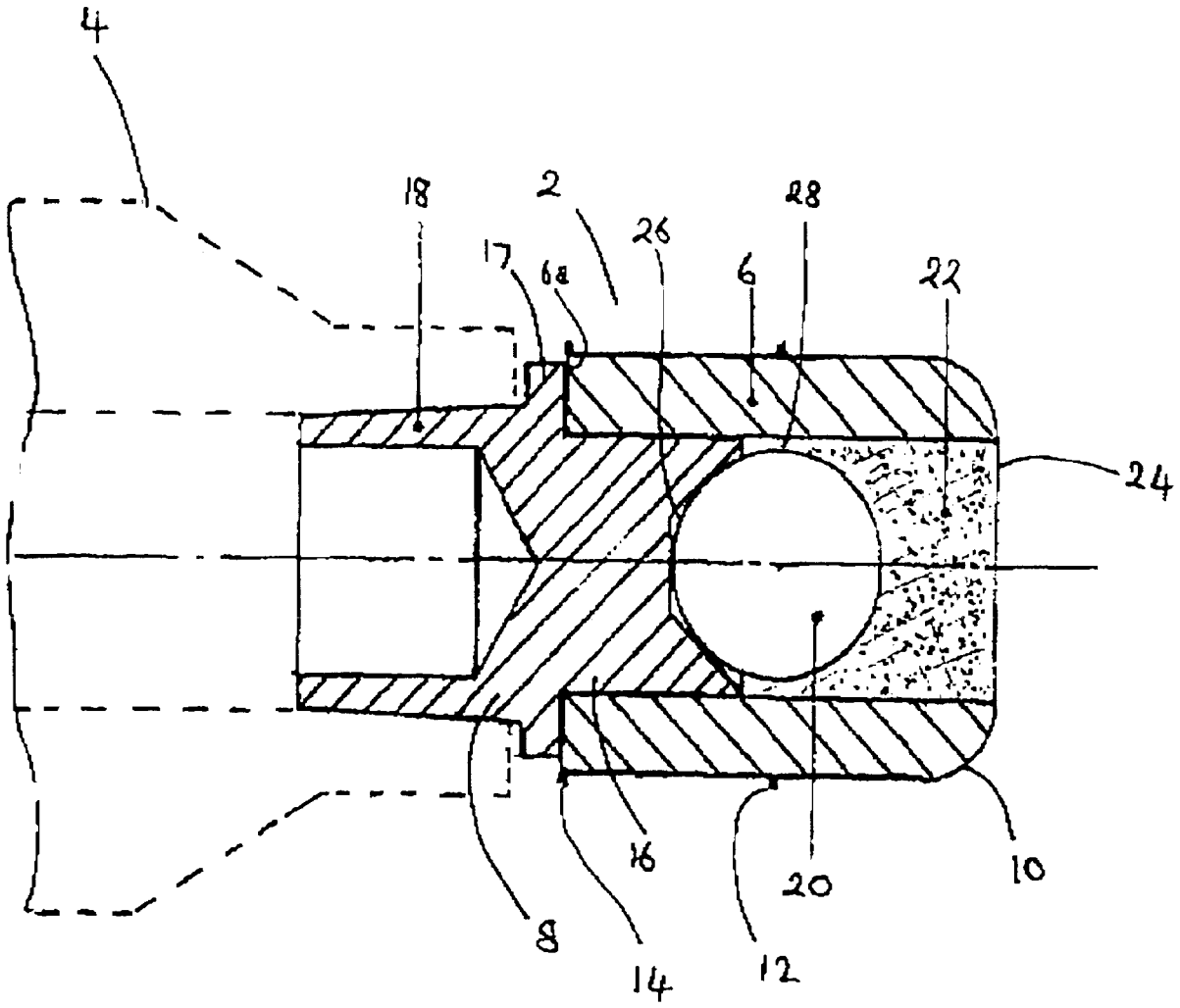
FIG. 1 is a longitudinal sectional elevation of a marker bullet mounted in the end of a cartridge before firing.
Figure 2:
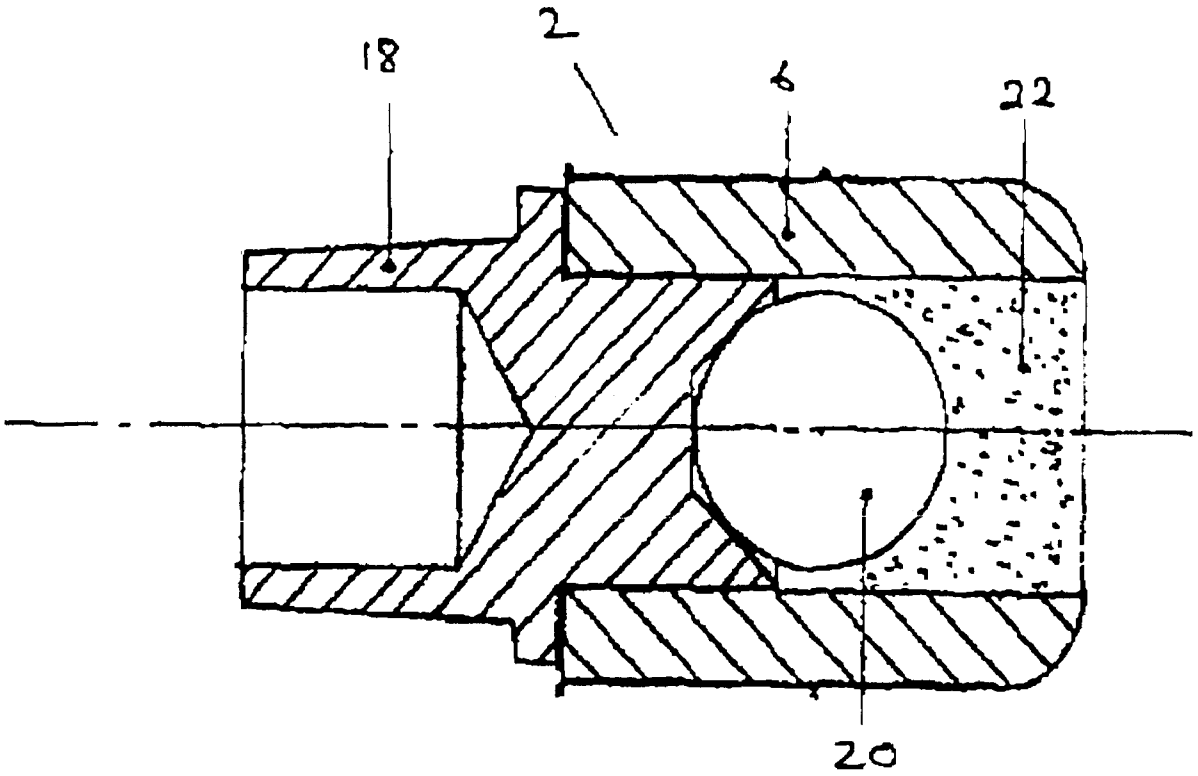
FIG. 2 is a sectional elevation of the bullet of FIG. 1 after firing.

Referring now to the drawings FIG. 1 illustrates a bullet 2 force fitted into the 6 degree angle seating of a cartridge 4 (shown in dotted lines).

The bullet 2 comprises a sleeve 6, which in this embodiment is formed from a metal (preferably aluminium), and a core body portion 8, which in this embodiment is formed from a plastics material. The sleeve is of generally cylindrical form and has a radiused nose portion, and a pair of thin peripheral flanges 12 and 14 which function as driving bands. In use, the driving bands 12 and 14 engage with (engrave in) the rifling in the barrel of a gun in order to spin the bullet and therefore stabilise the bullet during flight.

The plastics core body portion 8 is securely mounted in the sleeve 6 by virtue of a compression fit of the spigot portion 16 within the sleeve. The core body portion has a hollow trailing end or skirt 18 which tapers rearwardly so as to enable it to be force fitted into he cartridge 4.

The core body 8 and sleeve 6 together define a forwardly opening chamber within which are disposed a metal ball 20 (e.g. formed of steel) and a marking substance 22. The marking substance is of a consistency which enables it to retain its shape within the chamber and not ooze out through the front opening 24 prior to impact. Advantageously, the marking substance is a waxy material. The metal ball 20 is not a tight fit within the sleeve but, instead, there is an annular clearance 28 between the ball and inner sleeve wall. The purpose of the clearance is to ensure that the movement of the ball within the sleeve is constrained only by the viscosity of the marking substance and not by any friction between the ball and sleeve wall.

The spigot portion 16 of the core body portion 8 has a generally frustoconical recess 26 set into its leading face. The frustoconical recess, which may be formed for example either by moulding or by drilling, serves as a seat for the metal ball 20 and provides a means of centring the ball within the sleeve. This centring means is of considerable importance in preventing lateral movement of the ball during flight and thereby avoiding any destabilising effect of such lateral movement on the flight of the bullet.

In use, when the cartridge is fired in a gun, the propellant gases generated within the cartridge eject the bullet from the cartridge and down the gun's barrel. As the bullet accelerates down the barrel, the ball is forced back into the frustoconical recess 26 which thereby centres the ball for the duration of flight of the bullet preventing lateral movement of the ball and ensuring good ballistic stability of the bullet in the air. It will be appreciated from the drawings that no forward movement of the spigot portion 16 relative to the sleeve 6 takes place during firing and flight of the bullet. Such forward movement is prevented by the abutment flange 17 of the core body portion 8 which abuts against rearwardly facing surface 6*a* of the sleeve.

Figure 3:
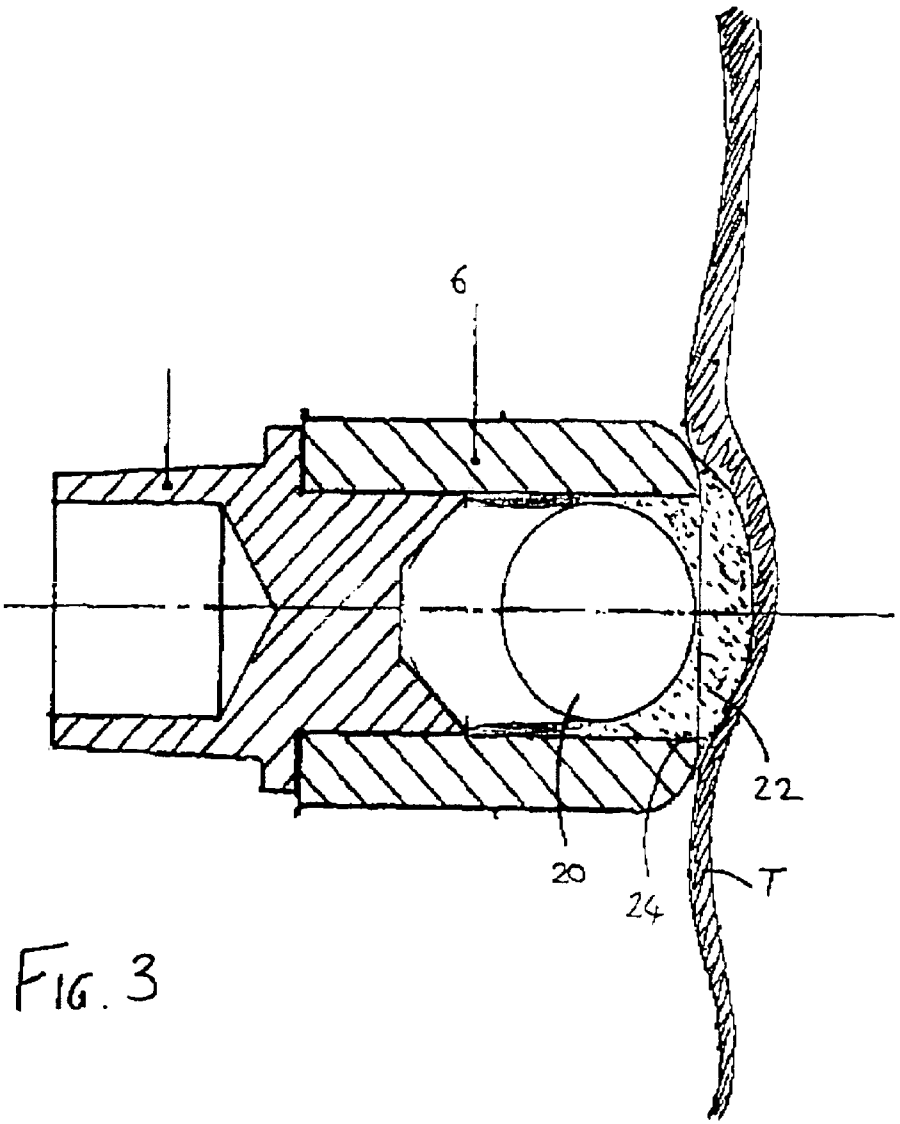
FIG. 3 is a sectional elevation of the bullet of FIGS. 1 and 2 after impact with a target.

As shown in FIG. 3, when the bullet hits a target, movement of the sleeve 6 is arrested, but the momentum of the ball 20 carries it forwards in the chamber such that it expels the marking substance out through the opening 24 and onto the target T. The metal ball 20 typically will be cushioned by the marking substance and may not itself come into contact with the target T, but even if it does, the residual momentum of the ball will not be sufficient to cause damage to the target.

Thus, as can be seen, in the projectiles of the present invention, it is the momentum of the ball after impact of the bullet on a target that causes the marking substance to be expelled. This is in contradistinction to the projectiles illustrated in GB 2 284 252 where the marking substance is forced out through the nose of the bullet by the pressure of the propellant gases acting on the piston behind the marking substance when the cartridge is fired.

The illustrated bullet has a metal outer sleeve within which is accommodated the spigot portion of the core body portion which is formed of a plastics material. By shifting the weight of the bullet to the periphery in this way, the ballistics of the bullet are improved. As an alternative to the two-piece construction shown the core body portion and the sleeve could be formed integrally as a single moulding of a plastics material, or a single piece machined from a metal material, although this is less preferred.

The illustrated bullet is shown as having a tapering skirt portion for force fitting in a taper lock connection with the cartridge, but this is not essential. The trailing portion of the bullet can be shaped differently depending upon the nature of the propellant and the configuration of the cartridge (if used).

The advantages of the bullet of the present invention are several. Firstly, the bullet is not required to burst on impact with a target and therefore the force with which the bullet need impact against the target is reduced. This in turn reduces the potential for a person struck by the bullet to be injured by the bullet.

Secondly, the compact design of the bullet allows bullets of very small calibre, yet very good marking qualities on any surface, to be produced.

Thirdly, the mechanism for forcing the marking material out of the bullet on to the target upon impact ensures that marking substance is not prematurely ejected from the bullet and spread across the nose of the bullet by centrifugal force as the bullet is spun in the gun barrel.

It will readily be apparent that numerous modifications and alterations could be made to the bullet shown in the accompanying drawings without departing from the principles underlying the invention, and all such modifications and alterations are intended to be embraced by this application.

What I claim is:

1. A marker projectile comprising a hollow body having an opening at the front; a marking substance disposed within the hollow body and closing the opening; and an expelling member within the hollow body behind the marking substance, with both the marking substance and the expelling member disposed within a chamber in said hollow body; characterized in the hollow body and the expelling member are configured such that upon impact of the projectile with a target, the momentum of the expelling member relative to the hollow body carries the expelling member forwardly to expel the marking substance through the opening.

2. A marker projectile according to claim 1 wherein the hollow body is provided with means for centering the expelling member therein during flight of the projectile.

3. A marker projectile according to claim 2 wherein the centering means is a recess in a forwardly facing surface within the interior of the hollow body.

4. A marker projectile according to claim 2 wherein the centering means comprises a recess in the said forwardly facing surface of the core body portion.

5. A marker projectile according to claim 3 wherein the recess is conical, frustoconical, hemispherical or part hemispherical.

6. A marker projectile according to claim 1, wherein the hollow body comprises a sleeve having a core body portion secured within a rear end thereof, the sleeve having an inner wall, said inner wall of the sleeve and a forwardly facing surface of the core body portion defining the chamber within which the marking substance and expelling member are disposed.

7. A marker projectile according to claim 6 wherein the hollow body is provided with means for centering the expelling member therein during flight of the projectile.

8. A marker projectile according to claim 7 wherein the centering means is a recess in a forwardly facing surface within the interior of the hollow body.

9. A marker projectile according to claim 8 wherein the forwardly facing surface is a forwardly facing surface of the core body portion.

10. A marker projectile according to claim 9 wherein the recess is conical, frustoconical, hemispherical or part hemispherical.

11. A marker projectile according to claim 6 wherein the sleeve has a cylindrical form, and a spigot portion of the core body member is received within the rear end of the sleeve.

12. A marker projectile according to claim 6 wherein the sleeve is formed from a material having a greater density than the material from which the core body portion is formed.

13. A marker projectile according to claim 12 wherein the sleeve is formed from a metal material and the core body portion is formed from a plastics material.

14. A marker projectile according to claim 13 wherein the sleeve is formed from aluminium.

15. A marker projectile according to claim 1 wherein the expelling member is formed from a material having a greater density than the material(s) from which the hollow body is formed.

16. A marker projectile according to claim 6 wherein the expelling member is formed from a material having a greater density than the material(s) from which the hollow body is formed.

17. A marker projectile according to claim 16 wherein the expelling member is formed from steel.

18. A marker projectile according to claim 6 wherein the expelling member has a greater density than the sleeve and the core body portion.

19. A marker projectile according to claim 1 wherein the expelling member is of a spherical shape.

20. A marker projectile according to claim 6 wherein the expelling member is of a spherical shape.

21. A marker projectile according to claim 19 wherein the expelling member is a solid sphere.

22. A marker projectile according to claim 6 wherein there is a radial clearance between the expelling member and the inner wall of the sleeve such that there is no contact between the sleeve wall and the expelling member when the expelling member is centred.

23. A marker projectile according to claim 6 wherein means are provided for preventing forwards movement of the core body member relative to the sleeve.

24. A marker projectile according to claim 6 wherein the sleeve is provided with one or more circumferential flanges which function as driving bands for engaging rifling in a gun barrel to spin the projectile.

25. A combination of a cartridge and a marker projectile comprising a hollow body having an opening at the front; a marking substance disposed within the hollow body and closing the opening; and an expelling member within the hollow body behind the marking substance, with both the marking substance and the expelling member disposed within a chamber in said hollow body; characterized in that the hollow body and the expelling member are configured such that upon impact of the projectile with a target, the momentum of the expelling member relative to the hollow body carries the expelling member forwardly to expel the marking substance through the opening.

* * * * *